US006559376B2

(12) United States Patent
Funk et al.

(10) Patent No.: US 6,559,376 B2
(45) **Date of Patent: *May 6, 2003**

(54) COMBUSTION INITIATION DEVICE AND METHOD FOR TUNING A COMBUSTION INITIATION DEVICE

(75) Inventors: Werner Funk, Olivenhain, CA (US); Ulf Arens, San Diego, CA (US)

(73) Assignee: Nology Engineering, Inc., San Marcos, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/535,781

(22) Filed: Mar. 28, 2000

(65) Prior Publication Data

US 2002/0129950 A1 Sep. 19, 2002

(Under 37 CFR 1.47)

Related U.S. Application Data

(63) Continuation-in-part of application No. 08/823,676, filed on Mar. 24, 1997, now abandoned.
(60) Provisional application No. 60/027,493, filed on Sep. 30, 1996.

(51) Int. Cl.[7] ..... H01B 7/00

(52) U.S. Cl. ..... 174/28
(58) Field of Search ..... 174/28, 102 R, 174/103, 36, 74 R, 84 R

(56) References Cited

U.S. PATENT DOCUMENTS

| | | | |
|---|---|---|---|
| 1,447,812 | A | 3/1923 | Otto |
| 1,756,486 | A | 4/1930 | Henry |
| 1,902,541 | A | 3/1933 | Brown et al. |
| 2,129,472 | A | 9/1938 | Lysholm et al. |

(List continued on next page.)

*Primary Examiner*—Dean A. Reichard
*Assistant Examiner*—WIlliam H. Mayo, III
(74) *Attorney, Agent, or Firm*—Luce, Forward, Hamilton & Scripps LLP

(57) ABSTRACT

An ignition cable constructed according to a method for optimizing an ignition cable, the cable including at least a capacitor, where the ignition cable carries current from a power source to a spark plug located in a combustion chamber. The ignition cable includes a center element structured to communication electric current from the power source to the sparkplug and an insulator surrounding the center element. The conductor is removably coupled to a ground, and surrounds at least a portion of the insulator. The center element, insulator and conductor form a capacitor having an optimal capacitance value that is determined by finding a maximum capacitance value and subtracting a safety margin.

22 Claims, 4 Drawing Sheets

U.S. PATENT DOCUMENTS 2,173,766 A 9/1939 Ramsey
2,376,362 A 5/1945 Kasarjian
2,378,893 A 6/1945 Berkey et al.
2,415,138 A 2/1947 Kasarjian
2,459,855 A * 1/1949 Wall ..... 315/85
2,640,174 A 5/1953 Short et al.
2,904,723 A 9/1959 Altrogge et al.
2,927,248 A 3/1960 Ramsay
2,939,905 A * 6/1960 Canifield ..... 174/71
3,045,148 A 7/1962 McNulty
3,324,347 A 6/1967 Brugnola
3,336,506 A 8/1967 Frank
3,361,932 A 1/1968 Campbell
3,649,876 A * 3/1972 Mandock et al. ..... 317/96
3,683,232 A 8/1972 Baur
3,842,819 A 10/1974 Atkins et al.
4,082,980 A 4/1978 Yoshikawa et al.
4,103,276 A * 7/1978 Kennon et al. ..... 338/214
4,122,816 A 10/1978 Fitzgerald et al.
4,123,688 A 10/1978 Yoshikawa et al.
4,223,656 A 9/1980 Hamley
4,324,219 A 4/1982 Hayashi
4,333,125 A 6/1982 Hensley et al.
4,333,126 A 6/1982 Hensley et al.
4,402,036 A 8/1983 Hensley et al.
4,506,235 A * 3/1985 Mayer ..... 333/12
4,510,468 A * 4/1985 Mayer ..... 333/12
4,549,114 A 10/1985 Herden
4,589,398 A * 5/1986 Pate et al. ..... 123/596
4,590,536 A 5/1986 Gerry
4,613,789 A 9/1986 Herden et al.
4,631,451 A 12/1986 Anderson et al.
4,636,690 A 1/1987 Herden et al.
4,658,185 A 4/1987 Albrecht et al.
4,727,891 A 3/1988 Schmidt et al.
4,746,834 A 5/1988 Bauerle et al.
4,751,430 A 6/1988 Muller et al.
4,824,385 A * 4/1989 Sturdevan ..... 439/128
4,841,259 A * 6/1989 Mayer ..... 333/17.2
5,012,125 A * 4/1991 Conway ..... 307/149
5,376,886 A * 12/1994 Shimasaki et al. ..... 324/402
5,397,860 A * 3/1995 Yochum et al. ..... 174/113 C
5,593,524 A * 1/1997 Philips ..... 156/244.12
5,716,223 A * 2/1998 Phillips, Jr. et al. ..... 439/125
5,866,843 A * 2/1999 Ikeda ..... 174/36

* cited by examiner

COMBUSTION INITIATION DEVICE AND METHOD FOR TUNING A COMBUSTION INITIATION DEVICE

REFERENCE TO RELATED APPLICATION

This is a continuation-in-part of application Ser. No. 08/823,676, filed Mar. 24, 1997, entitled ENVIRONMENTAL SPARK PLUG-CABLE WITH COAXIAL CD-IGNITION EFFECT, now abandoned, based on Provisional Application Ser. No. 60/027,493, filed Sep. 30, 1996.

BACKGROUND OF THE INVENTION

1. Field of the Invention

The present invention generally relates to initiating combustion of fuel-air mixtures. More particularly, the invention concerns a spark plug cable and a method for tuning a spark plug cable system to maximize combustion of fuel-air mixtures in internal combustion engines.

2. Discussion of the Related Art

The purpose of an ignition system is to initiate combustion of a flammable fuel-air mixture by igniting it at precisely the right moment. In spark-ignition engines, this is achieved with an electrical spark, that is, by an ark discharged between two, or more electrodes of a spark plug. An electrical potential difference, or voltage builds between the spark plug electrodes until a spark arks from one electrode to the other(s). The voltage is created by the delivery of current to the center electrode of the spark plug. A spark plug cable, or ignition wire delivers the current from a current generating device, such as a coil to the spark plug.

Combustion initiation in modern-day spark ignition engines is becoming increasingly difficult. This is because engine designs that increase fuel economy and reduce harmful environmental emissions have created unfavorable conditions for fuel-air ignition. Modern-day engines employ lean fuel-air mixtures that are difficult to ignite. Turbochargers and superchargers are also employed to increase engine efficiency. However, the increased engine combustion chamber pressures gene turbochargers and superchargers also hinder combustion. In addition, the spacing, or gap between the spark plug's electrodes has increased, thereby increasing the amount of voltage necessary to create an ark.

SUMMARY OF THE INVENTION

The present invention solves the problem of igniting fuel-air mixtures in the difficult conditions found in modern-day engines. Broadly, the present invention provides for complete fuel-air combustion, thereby increasing engine power and decreasing harmful environmental emissions.

One embodiment of a spark plug cable constructed according to the present invention comprises a core wire extending between two ends, with one end coupled to a spark plug connector and the other end coupled to a power source. An insulator encases the core wire and a metallic sleeve encases at least a portion of the insulator. The metallic sleeve is also removeably coupled to an electrical ground. The metallic sleeve, insulator and core wire form a capacitor. An optimal capacitance value is determined by finding a maximum capacitance value and subtracting a safety margin.

Another method of the invention optimizes spark duration by coupling a resistor and a capacitor to the spark plug cable, determining an available charge from the capacitor, and selecting an ideal resistance value based on the available charge, wherein the ideal resistance value will enable the generation of a very powerful spark, thereby maximizing combustion of the fuel-air mixture.

However, the claims alone—not the preceding summary—define the invention.

BRIEF DESCRIPTION OF THE DRAWING

The nature, goals, and advantages of the invention will become more apparent to those skilled in the art after considering the following detailed description when read in connection with the accompanying drawing—illustrating by way of examples the principles of the invention—in which like reference numerals identify like elements throughout wherein.

It will be recognized that some or all of the Figures are schematic representations for purposes of illustration and do not necessarily depict the actual relative sizes or locations of the elements shown.

DETAILED DESCRIPTION OF THE PREFERRED EMBODIMENTS

In the following paragraphs, the present invention will be described in detail by way of example with reference to the attached drawings.

General

Throughout this description, the preferred embodiment and examples shown should be considered as exemplars, rather than as limitations on the present invention.

Figure 1:
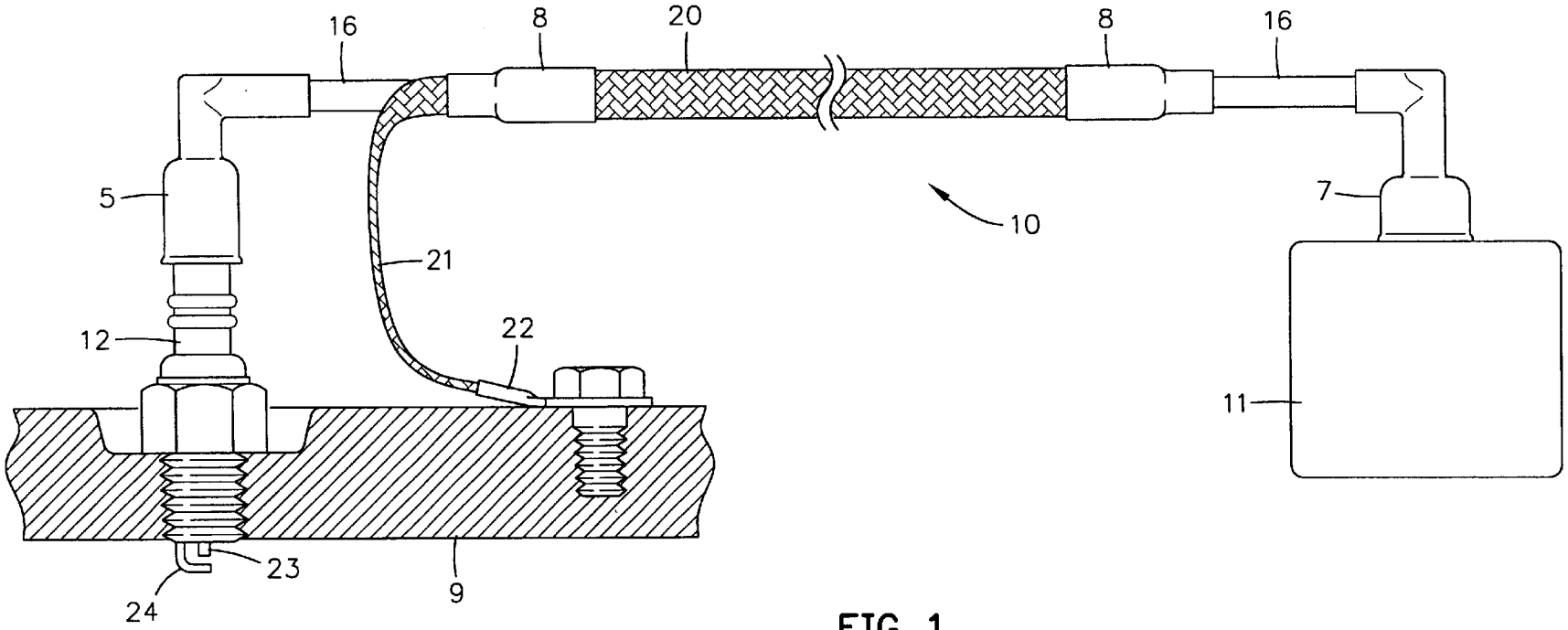
FIG. 1 is an elevation view of one embodiment of the present invention in the form of a spark plug cable.

The purpose of an ignition system is to produce a powerful enough spark to initiate combustion of a fuel-air mixture. As shown in FIG. 1, an automotive ignition system comprises, in part, a spark plug 12 mounted in a cylinder head 9, a spark plug cable or ignition wire 10 and a current or power source 11 such as a coil. The spark plug cable is coupled to the spark plug by a spark plug boot 5 and to the power source by a power source boot 7. An ideal ignition system will ignite all of the fuel-air mixture and will ignite the fuel-air mixture at the precise moment to create maximum power. Therefore, the ignition system must be consistent and precise. An optimized ignition system will produce more power and less harmful environmental pollutants.

As shown in the drawings for purposes of illustration, an ignition wire, or spark plug cable constructed and optimized according to the method of the present invention provides a way to improve fuel-air combustion. The spark plug cable is tuned to provide current to the spark plug in a manner that creates an increased spark intensity, or power compared to conventional spark plug cables. In addition, the present invention provides a method for optimizing spark duration, that is, the amount of time the spark lasts, by adjusting, or tuning the spark plug cable components relative to each other.

Structure

Figure 2:
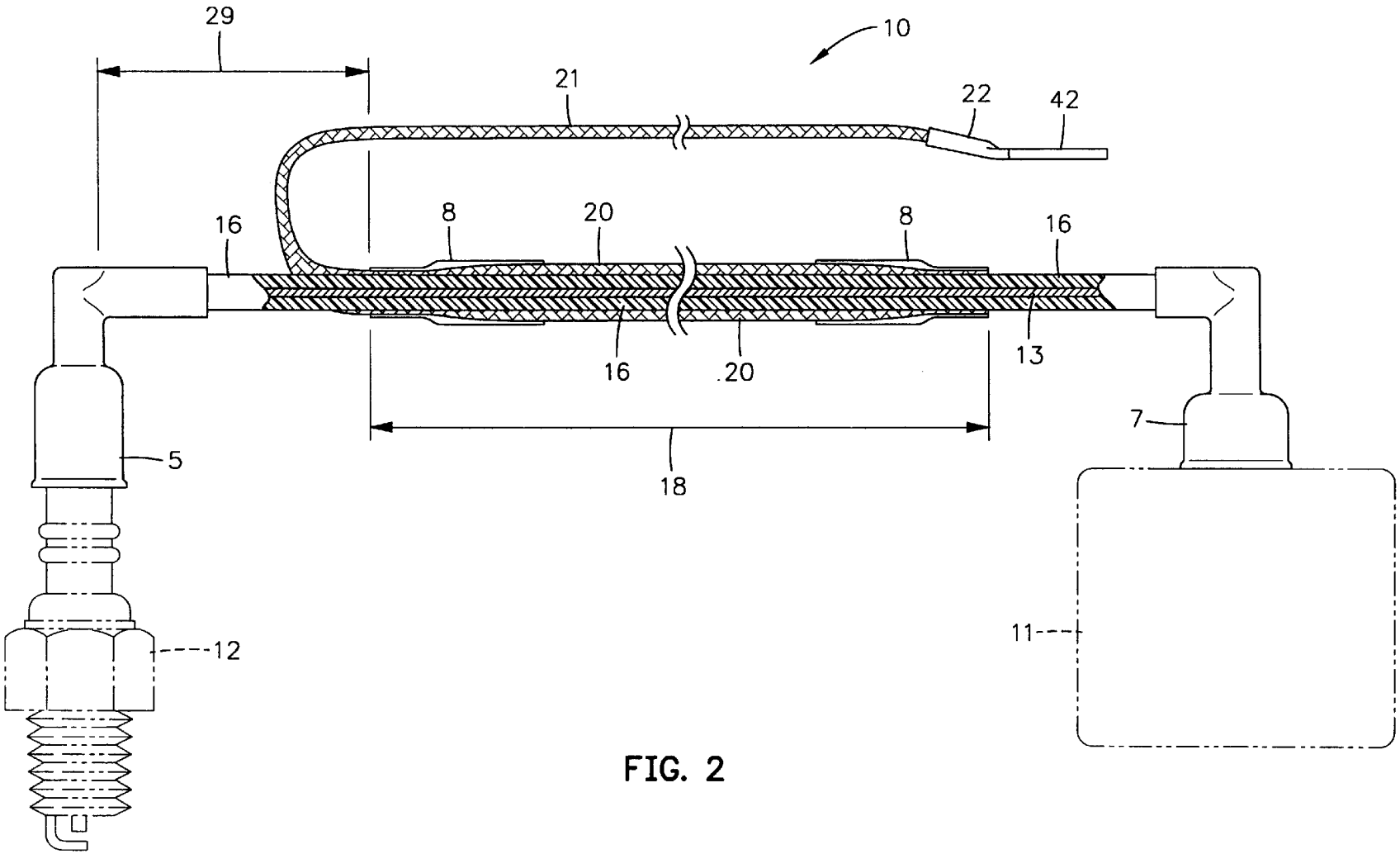
FIG. 2 is a cut-away elevation view of a spark plug cable constructed according to the method of the present invention.

As shown in FIGS. 1 and 2, a spark plug cable, or ignition wire constructed in accordance with one method of the present invention is illustrated and designated generally by the numeral 10. The spark plug cable is configured to carry current from a current or power source 11 to a spark plug 12. The power source is usually an ignition coil, however a magneto or other suitable device can also be used. Center element or core strand 13 carries the current from the power source 11 to the spark plug 12. The spark plug cable also comprises an insulator or dielectric 16 surrounding the core strand and a conductor 20 that extends along a section of the spark plug cable and surrounds at least a portion of the insulator. Protective boots 8 are employed in some embodiments to cover the ends of the conductor, and to keep the conductor securely attached to the insulator. In one embodiment, the conductor has a ground strap 21 that is fixed to a ground by connector 22. The core strand and conductor are configured to form the electrodes of a capacitor. Current sent from the power source 11 is stored in the capacitor and later delivered to the spark plug creating a powerful spark.

Figure 3:
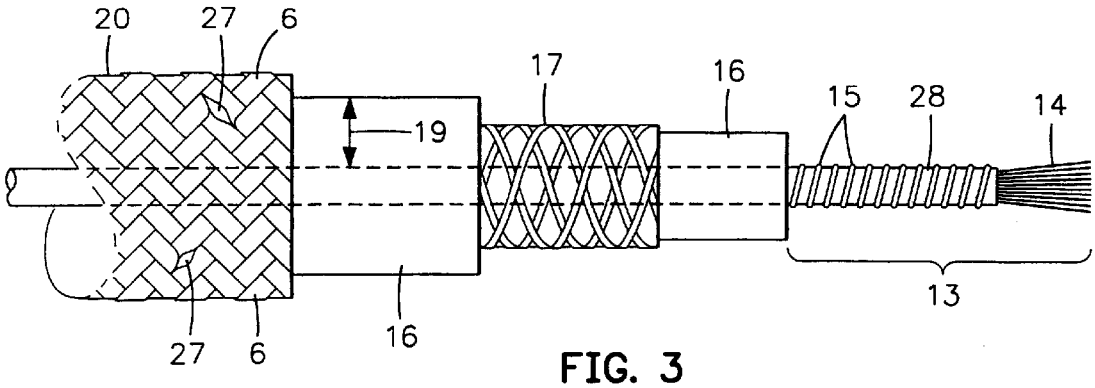
FIG. 3 is an elevation view of a section of the embodiment of FIG. 2, showing specific elements of the spark plug cable.

Referring to FIG. 3, one embodiment of a spark plug cable constructed according to the present invention comprises a core strand or element 13 constructed of a central fiber 14, cover 28 and spiral-wound wire 15. The central fiber is comprised of a super low conductive material having a resistance of 7,000 Ohm per inch. The central fiber can be comprised of one single element, or it can be comprised of a plurality of filament-like elements. When multiple filaments are employed, a cover 28 is used to bundle the filaments together. The central fiber is surrounded by an approximately 0.1 millimeter (mm) diameter helical-, or spiral-wound wire 15 having approximately 65 windings per inch. In this embodiment, the resistance of the core strand, comprised of the central fiber, cover and the spiral-wound wire, is approximately 28 Ohm per inch.

An alternative embodiment core strand is comprised of a central fiber 14 having a plurality of filament-like elements bound together by cover 28. In this embodiment, a ferromagnetic material, in a powder-like form, is bound by the cover 28 to the filaments. Surrounding the cover is an approximately 0.15 millimeter (mm) diameter helical-, or spiral-wound wire 15 having approximately 82 windings per inch. In this embodiment, the resistance of the core strand, comprised of the central fiber, ferromagnetic powder, cover and the spiral-wound wire, is approximately 14 Ohm per inch. Other embodiment spiral-wound wires could be larger or smaller in diameter, thereby varying the overall resistance of the core strand. Another way to vary the overall resistance of the core strand is to change the number of spiral-wound wire windings per inch. Alternatively, any conductive material can be used to form the core strand, such as steel, silver, copper or other suitable materials.

Surrounding the spiral-wound strand 15 is dielectric, or insulator 16. A preferred embodiment uses a high-purity silicone dielectric, but rubber or other suitable dielectric materials can also be employed. As shown in FIG. 3, one specific embodiment uses a two-layer dielectric separated by a woven fiberglass member 17. The fiberglass member reinforces and supports the dielectric. Dielectric 16 can vary in thickness from about 2.5 mm to about 5 mm. That is, the outer diameter of the dielectric can vary from about 5 mm to about 10 mm.

As shown in FIGS. 2 and 3, conductor 20 surrounds the dielectric material. Any conductive material can be used to form the conductor, such as steel, silver, copper or other suitable materials. A preferred embodiment conductor is comprised of a braided copper wire having tin plating. One specific embodiment conductor uses 36-gauge copper wire woven into bundles or threads 6 to form a flexible, collapsible tube. The woven wire in this specific embodiment is comprised of 24 bundles, each bundle having 16 individual filaments. An alternative embodiment conductor can be comprised of woven flexible tubes made of 36 bundles, with each bundle having 7 individual filaments, with each filament being 30-gauge wire. Another alternative embodiment conductor can be comprised of woven flexible tubes made of 48 bundles, with each bundle having 7 individual filaments, with each filament being 32-gauge wire.

As shown in FIG. 3, a plurality of openings or spaces 27 can be formed between the individual bundles 6. However, these openings can be minimized or eliminated by manipulating the flexible wire tubes. For example, a preferred embodiment conductor tube achieves approximately 95% coverage of the dielectric. However, alternative embodiment conductor tubes can cover about 75% to about 100% of the dielectric.

Referring to FIG. 2, the bundles 6 comprising the tube-like conductor 20 can be collapsed so that one end of the conductor 20 forms a flexible, substantially flat ground strap 21. The ground strap is formed when the spark plug cable 10 is assembled. One opening 27 between the bundles comprising the conductor is enlarged to allow passage of the insulator 16 and core strand 13. In one embodiment, the ground strap 21 terminates with connector 22 comprising a ring terminal, or wire terminal 42 for securely connecting by a suitable fastener to a ground, such as an engine block.

A spark plug cable constructed using a flexible conductor 20 according to the present invention can be packaged by flexing or compressing the flexible conductor into any necessary configuration. Prior art capacitive spark plug cables using rigid capacitors have limited applications because of the packaging limitation of a rigid cylindrical object.

Operation and Tuning

Figure 4:
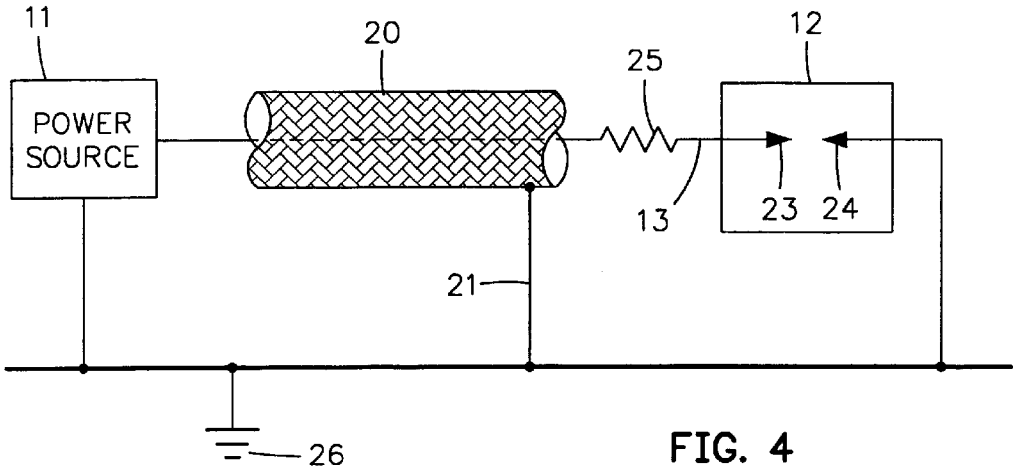
FIG. 4 is a schematic circuit diagram depicting ignition system components and a spark plug cable constructed according to a method of the present invention.

FIG. 4 is a schematic circuit diagram of one embodiment of a tuned, or optimized spark plug cable constructed according to the method of the present invention. The conductor 20 is positioned between the power source 11, such as a coil, and the center electrode 23 of a spark plug 12. Ground strap 21 connects the conductor to ground 26 preferably located on the engine. In one embodiment, core strand 13 is configured to have a resistance 25 of about 28 Ohm per inch. One theory of the operation of a spark plug cable constructed according to the present invention is that when current is sent from the power source through the core strand, the current is attracted to the ground 21 of a capacitor formed by the conductor, insulator 16 and the core strand. The core strand 13 and conductor 20 become capacitor electrodes separated by the insulator. The capacitor stores the energy sent by the coil until its capacity is reached. A final amount of energy sent by the coil passes the capacitor and generates sufficient voltage between spark plug electrodes 23 and 24 to create a spark. The capacitor then discharges, sending all of its stored energy to the spark plug in a burst, creating a powerful spark.

Prior art spark plug cables without capacitors simply delivered the coil energy to the spark plug. However, the coil cannot deliver the required energy in a short burst, but instead requires time to generate it. This creates a spark duration or time that is too long—between about two to four thousands of a second (0.002–0.004 sec). A long spark duration decreases spark power, because Power=Work/time. Therefore, by decreasing spark duration, spark power can be increased. Increased spark power improves the performance of modern-day engines that use lean fuel-air mixtures and have high combustion chamber temperatures and pressures.

Prior art devices delivered the stored capacitor energy in too short a time, creating a spark duration so short that ignition of the fuel-air mixture was erratic, or non-existent. Alternatively, the capacitance was too small, generally because the capacitor's size was limited by space constraints, and there was no improvement in ignition of the fuel-air mixture.

The capacitor mounted on the spark plug cable was often too large and the capacitor stored all of the energy sent by the coil. In this situation, no spark is generated to initiate fuel-air combustion.

A spark plug cable configured according to the method of the present invention has a spark duration in the range of 40 to 1000 nanoseconds. Therefore, spark power is significantly increased, and complete combustion, even under unfavorable conditions is assured. In addition, the spark plug cable capacitor is carefully sized, or tuned to the coil so that the capacitor is fully charged, yet sufficient energy is generated at the center electrode 23 to create a spark. Also, the resistance of the core strand 13 must be optimized so that spark duration is in the desired range to initiate combustion. A spark plug cable that performs as described above must be carefully tuned and constructed.

Figure 5:
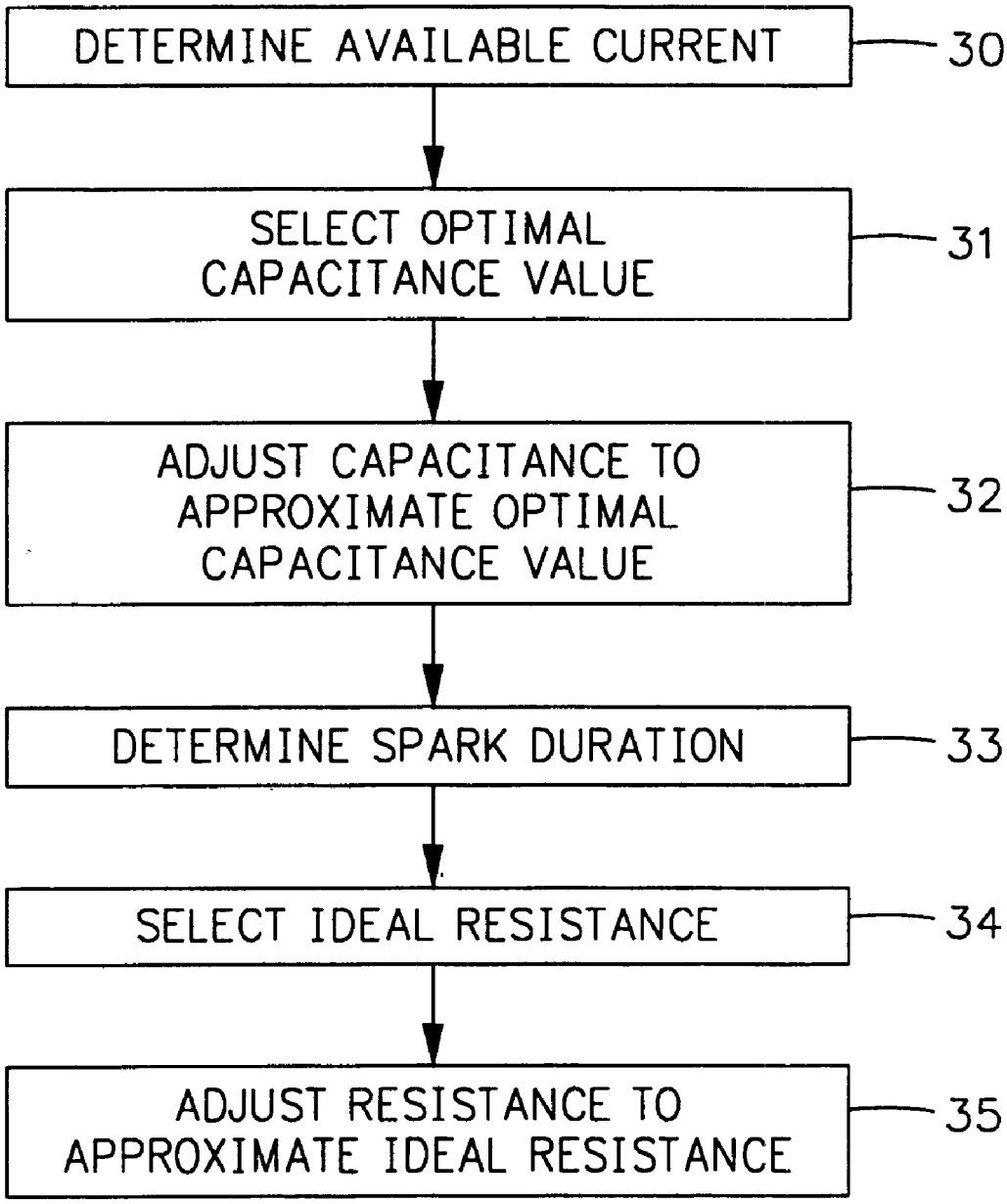
FIG. 5 is a flow chart depicting a method for optimizing a spark plug cable according to the present invention.

FIG. 5 depicts a method for tuning spark plug cable 10 having an optimal capacitance value. The method of the present intention can be used to construct a spark plug cable that can be used on any device requiring spark ignition of a flammable fuel, such as 2-stroke engines, 4-stroke engines, and other fuel burning devices.

The first step 30 is to determine the available current. This is accomplished by inspecting the power source to determine its output. A conventional power source employs an ignition coil that amplifies 12 volts (V) received from a conventional battery to approximately 20,000 V. Alternative power sources can supply 6, 24, 36 or 42 volts to the ignition coil. Moreover, voltages can range from 5,000 V to 80,000 V, or more, depending upon the coil characteristics.

The next step 31 is to select an optimal capacitance value. The capacitor must be sized so that it becomes fully charged, yet it must also allow passage of sufficient energy or current to create a spark at the spark plug. If the capacitance of the capacitor is too large, a spark will not form and combustion of the fuel-air mixture will not occur. Conversely, if the capacitance of the capacitor is too small, spark intensity will not change, and there will be no improvement to ignition of the fuel-air mixture. A capacitor having an optimal capacitance value is determined by finding a maximum capacitance value and subtracting a safety margin.

For example, different spark plug cables can be constructed to exhibit different capacitance values, such as those of Table 1, shown below.

TABLE 1

| Spark Plug Cable # | Cable Length (inches) | Capacitor Length (inches) | Capacitance (pico farads) |
|---|---|---|---|
| 1 | 30" | 0 | 0 |
| 2 | 30" | 5 | 18 |
| 3 | 30" | 10 | 33 |
| 4 | 30" | 15 | 48 |
| 5 | 30" | 20 | 63 |
| 6 | 30" | 25 | 74 |
| 7 | 40" | 35 | 95 |

The different spark plug cables can then be tested with coils having different output voltages. The optimal capacitance value will vary based on the size of the coil used in the ignition system. For example, in the three tests shown below, three different coils having outputs of 40,000 volts (40 kV), 60 kV and 70 kV, require three different spark plug cable capacitors.

TEST 1

| | |
|---|---|
| Chamber Pressure | 100 psi of Nitrogen |
| Frequency | 250 Hz |
| Plug Gap | 0.050" |
| Coil Output Voltage | 40 kV |

| Spark Plug Cable # | Spark Generation |
|---|---|
| 1 | Conventional spark |
| 2 | Optimal Spark |
| 3 | Intermittent sparking |
| 4 | No spark |
| 5 | No spark |
| 6 | No spark |
| 7 | No spark |

TEST 2

| | |
|---|---|
| Chamber Pressure | 100 psi of Nitrogen |
| Frequency | 250 Hz |
| Plug Gap | 0.050" |
| Coil Output Voltage | 60 kV |

| Spark Plug Cable # | Spark Generation |
|---|---|
| 1 | Conventional spark |
| 2 | Conventional spark |
| 3 | Conventional spark |
| 4 | Optimal Spark |
| 5 | Intermittent sparking |
| 6 | No spark |
| 7 | No spark |

TEST 3

| | |
|---|---|
| Chamber Pressure | 100 psi of Nitrogen |
| Frequency | 250 Hz |
| Plug Gap | 0.050" |
| Coil Output Voltage | 70 kV |

| Spark Plug Cable # | Spark Generation |
|---|---|
| 1 | Conventional spark |
| 2 | Conventional spark |
| 3 | Conventional spark |
| 4 | Conventional spark |
| 5 | Conventional spark |
| 6 | Optimal Spark |
| 7 | Intermittent sparking |

As shown in the test results above, to achieve optimum spark, the capacitance value of the spark plug cable must be increased as the voltage output of the coil increases. The optimal capacitance value for each ignition system is determined by finding the maximum capacitance value and subtracting a safety margin. The maximum capacitance value is the capacitance value of the spark plug cable that causes intermittent, sporadic or no spark at the spark plug. For example, in Test 1, the maximum capacitance value is 38 pF, found in spark plug cable 3. In Test 2, the maximum capacitance value is 63 pF, found in spark plug cable 5. And in Test 3, the maximum capacitance value is 95 pF, found in spark plug cable 7.

To make certain that a spark is developed at the spark plug under virtually all conditions, a small safety margin is subtracted from the maximum capacitance value to arrive at the optimal capacitance value. A capacitance decrease of about 10 to 15 pF has been found to be a sufficient safety margin. This allows for manufacturer variations, power source deterioration, transient ignition system conditions and other effects.

Once the small safety margin has been subtracted from the maximum capacitance value, the optimal capacitance value is found. In test 1, the optimal capacitance value is 18 pF, found in cable 2. In test 2, the optimal capacitance value is 48 pF, found in cable 4, and in test 3, the optimal capacitance value is 74 pF, found in cable 6.

Therefore, the optimal capacitance value for a specific ignition system can be determined and a spark plug cable can be constructed accordingly. The method of constructing a spark plug cable according to the present invention allows for the optimum spark to be developed by tuning the spark plug cable to the specific ignition system requirements.

As shown in FIG. 5, the next step 32 in tuning the spark plug cable 10 is to adjust the capacitance of the capacitor so that it matches the optimal capacitance value. One way to adjust a capacitor's capacitance is to vary its surface area. Therefore, one tuning method is to simply adjust length 18, shown in FIG. 2, of conductor 20 to reach the desired capacitance value. This length can vary from about 5 to 40 inches.

One advantage of the present invention is that because the conductor 20 is comprised of a flexible braided wire tube, the surface area of the conductor can be increased or decreased by opening or closing the plurality of spaces 27, shown in FIG. 3, that exist between the braided bundles 6. For example, a motorcycle with a high-voltage coil requiring a large capacitor will only accommodate a short spark plug cable. The conductor can be compressed so that the spaces between the wire bundles are removed, thereby increasing its surface area and capacitance of the spark plug cable.

Another way of sizing the capacitor is to increase the surface area of the spiral-wound wire 15 located about the central fiber 14 of core strand 13. The surface area is increased by increasing the number of windings per inch. This increases the surface area of the core strand, thereby increasing the capacitance of the capacitor. However, it also increases the resistance of the core strand. This advantageous feature will be discussed in further detail below.

As shown in FIG. 3, another method of sizing, or tuning the capacitor is to increase the spacing 19 between the core strand 13 and the conductor 20, as capacitance can also be adjusted by changing the distance between the capacitor electrodes. This can be accomplished by changing the thickness of dielectric 16. A preferred embodiment dielectric has an outer diameter of about 8 millimeters, with a spacing 19 of about 4 mm. However, depending upon the capacitor requirements, a larger or smaller dielectric diameter could be employed.

As shown in FIG. 5, once the capacitor has been optimally sized, the next step 33 in tuning the spark plug cable 10 is to determine the ideal spark duration, or time. A long spark duration decreases spark power, because Power=Work/time. Therefore, by decreasing spark duration, spark power can be increased. Conventional ignition systems have a spark duration that is too long—between about two to four thousands of a second (0.002–0.004 sec). Prior art devices deliver the energy to create the spark in too short a time, creating a spark duration so short that ignition of the fuel-air mixture is erratic, or non-existent. Alternatively, an insufficient amount of energy is sent, resulting in no increase in spark power. A spark plug cable configured according to the method of the present invention has a spark duration in the range of 40 to 1000 nanoseconds. Therefore, spark power is significantly increased, and complete combustion, even under unfavorable conditions is assured.

Referring again to FIG. 5, once the correct spark duration is determined, the next step 34 in tuning the spark plug cable 10 is to select an ideal resistance. One unique aspect of the method of the present invention is to optimize, or tune the spark duration by adjusting the resistance of core strand 13. Greater resistance increases spark duration and conversely, less resistance decreases spark duration. A preferred embodiment spark plug cable 10 will have a spark duration of about 300 nanoseconds. However, depending upon the requirements of the ignition system, spark duration may range from about 40 to about 1000 nanoseconds.

An important factor when selecting ideal resistance is the capacitor characteristics. Prior art capacitors employing a rigid barrel-type structure will quickly "dump" its stored energy, creating a spark of extremely short duration. Spark durations that are too short will not ignite the fuel-air mixture. Conversely, spark durations that are too long will not increase the power of the spark, thereby having no beneficial effect. One advantage of the present invention is that conductor 20, comprised of a braided wire tube, can be configured to have a controlled release of its stored energy, thereby creating a spark of any specified duration. This is accomplished by using different wire braiding configurations, each having its own discharge characteristics. For example, a conductor comprised of a wire braid consisting of 24 bundles, each bundle having 16 individual filaments of 36-gauge copper wire, will have a different discharge characteristic than a conductor comprised of a wire braid consisting of 48 bundles, each bundle having 7 individual filaments of 32-gauge copper wire.

The ideal resistance is selected by examining the capacitance of the capacitor, the capacitor's discharge characteristics, and the resistance between the capacitor and the spark plug, as all of these factors affect spark duration.

Shown in FIG. 5, the next step 35 is to adjust the resistance of spark plug cable 10 to approximate the ideal resistance. As shown in FIG. 2, the resistance of consequence is the resistance generated by length 29 of core strand 13. Length 29 is the span between spark plug 12 and the end of conductor 20. This is the resistance the capacitor must overcome to send its stored energy to the spark plug.

One way to adjust the resistance is to increase the number of spiral-wound wires 15 per inch on core strand 13, shown in FIG. 3. A preferred embodiment core wire has a resistance of approximately 28 Ohm per inch. However, this resistance value can be increased or decreased depending upon the ignition system requirements. An alternative method is to increase length 29, thereby increasing the total resistance between the spark plug 12 and the end of conductor 20.

An important feature of the spiral-wound wires 15 is that they minimize electromagnetic interference (EMI) generated by the electrical energy sent to the spark plug. The EMI can be in the form of unwanted high-frequency electrical signals also known as radio-frequency interference (RFI). Modern engine electronics are extremely sensitive to EMI. Some ignition systems employing high-voltage coils can produce excessive, and damaging, amounts of EMI. The EMI is produced by current passing through the core strand creating a magnetic field.

Figure 6:
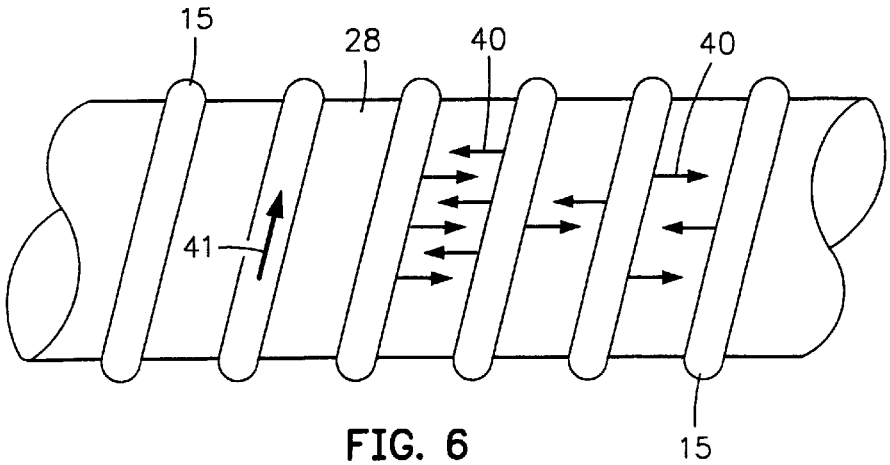
FIG. 6 is an elevation view showing the direction of a current and magnetic field generated by a component of the spark plug cable according to the present invention.

As shown in FIG. 6, the magnetic field 40 is emitted according to the Right-Hand Rule: the right thumb is pointed in the direction of the current 41, and the fingers are curled—indicating the direction of the magnetic field. However, one advantage of the present invention is that the substantially parallel spiral-wound wires 15 emit magnetic field energy towards each other, thereby substantially canceling each other and minimizing EMI. Therefore, the current invention is compatible with virtually any engine management system, including EMI and RFI sensitive systems.

Another way to minimize, or eliminate EMI is to use a ferromagnetic material in the core strand 13. The ferromagnetic material, containing iron, can absorb or modify any EMI generated. On embodiment of the present invention employs a core strand comprising ferromagnetic material, as described above. The core strand carries very high electric currents, and the ferromagnetic material absorbs any EMI generated.

Other Embodiments

Certain preferred embodiments have been described above. It is to be understood that a latitude of modification and substitution is intended in the foregoing disclosure, and that these modifications and substitutions are within the literal scope—or are equivalent to—the claims that follow.

Accordingly, it is appropriate that the following claims be construed broadly and in a manner consistent with the spirit and scope of the invention herein described.

What is claimed is:

1. A spark plug cable comprising:

a center element structured to communicate electric current from a power source to a spark plug;

an insulator surrounding substantially all of the center element; and a conductor surrounding at least a portion of the insulator;

wherein the center element, insulator and conductor comprise a capacitor, and wherein the capacitance of the capacitor is adjusted by increasing or decreasing a surface area of the center element.

2. The spark plug cable of claim 1, wherein the maximum capacitance value is determined when the sparking element receives electric current from the current source sporadically.

3. The spark plug cable of claim 1, wherein the safety margin is determined when the sparking element receives electric current from the current source consistently.

4. The spark plug cable of claim 1, wherein the conductor is comprised of a material selected from the group consisting of: conductive materials; copper; tin; brass and steel; and a combination of any one of copper, tin, brass and steel.

5. The spark plug cable of claim 1, wherein the center element has a length between about seven and forty inches.

6. The spark plug cable of claim 1, wherein the conductor is flexible.

7. The spark plug cable of claim 1, further including a spark plug connector and a power source connector coupled to the center element.

8. The spark plug cable of claim 1, wherein the center element is structured to minimize electromagnetic interference.

9. The spark plug cable of claim 1, wherein the center element is comprised of a core strand surrounded by a spiral-wound wire.

10. The spark plug cable of claim 1, wherein the center element is comprised of a material selected from the group consisting of: conducting materials; non-conducting materials; ferromagnetic materials; and non-ferromagnetic materials.

11. The spark plug cable of claim 1, wherein the capacitance of the capacitor is adjusted by:

changing a surface area of a center element by selectively increasing and decreasing a distance between a plurality of gaps in a wire that is wound about the center element.

12. The spark plug cable of claim 1, wherein the capacitance of the capacitor is varied by changing a surface area coverage of the spark plug cable by selectively lengthening and shortening a conductor that surrounds at least a portion of the spark plug cable.

13. A method for optimizing an ignition cable configured to carry electric current from a power source to a spark plug, the method of optimizing the ignition cable comprising the steps of:

providing an ignition cable comprising a center element, an insulator and a conductor, with the center element, insulator and conductor comprising a capacitor; and adjusting a capacitance of the capacitor by changing a surface area coverage of the ignition cable by lengthening or shortening the conductor that surrounds at least a portion of the ignition cable.

14. The method according to claim 13, wherein the step of adjusting the capacitance of the capacitor is accomplished by increasing a distance between an outer capacitor electrode and an inner capacitor electrode to decrease an electrical charge stored by the capacitor.

15. The method according to claim 13, wherein the step of adjusting the capacitance of the capacitor is accomplished by decreasing a distance between an outer capacitor electrode and an inner capacitor electrode to increase a charge stored by the capacitor.

16. The method according to claim 13, wherein the conductor is comprised of a material selected from the group consisting of: conductive materials; copper; tin; brass and steel; and any combination of any one of copper, tin, brass and steel.

17. The method according to claim 13, wherein the step of adjusting the capacitance of the capacitor is accomplished by:

changing a surface area coverage of the ignition cable by selectively increasing and decreasing a plurality of openings located between a plurality of strands of the conductor.

18. A method of optimizing an ignition cable comprising at least a resistor and a capacitor, the ignition cable configured to carry electric current from a power source to a spark plug, the method of optimizing the ignition cable comprising the steps of:

determining an available charge from the capacitor;

determining an ideal spark duration; and adjusting a resistance of the resistor by changing a length of the ignition cable so that when the electric current is delivered to the spark plug, a spark of ideal spark duration occurs.

19. The method according to claim 18, wherein the spark of ideal spark duration can range from about 40 nanoseconds to about 1000 nanoseconds.

20. The method according to claim 18, further including the step of:

suppressing electromagnetic interference generated by the ignition cable.

21. The method according to claim 18, wherein the step of suppressing electromagnetic interference is accomplished by winding a wire about a center element of the ignition cable.

22. The method according to claim 18, wherein the step of suppressing electromagnetic interference is accomplished by winding a wire about a center element of the ignition cable, the center element containing an electromagnetic interference suppressing material.

* * * * *